US008267189B2

(12) United States Patent
Manschitz et al.

(10) Patent No.: US 8,267,189 B2
(45) Date of Patent: Sep. 18, 2012

(54) HAND-HELD POWER TOOL WITH A PNEUMATIC PERCUSSION MECHANISM

(75) Inventors: Erwin Manschitz, Germering (DE); Reinhard Schulz, Munich (DE); Alexander Loeffler, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 256 days.

(21) Appl. No.: 12/214,132

(22) Filed: Jun. 16, 2008

(65) Prior Publication Data

US 2009/0020299 A1 Jan. 22, 2009

(30) Foreign Application Priority Data

Jul. 19, 2007 (DE) ..... 10 2007 000 393

(51) Int. Cl.
*B25D 11/12* (2006.01)

(52) U.S. Cl. ..... 173/104; 173/200; 173/201; 173/206; 173/216; 173/217; 173/48; 74/55; 74/56; 74/57

(58) Field of Classification Search ..... 173/104, 173/200, 201, 206, 216, 217, 48; 74/55–57
See application file for complete search history.

(56) References Cited

U.S. PATENT DOCUMENTS

| | | | | |
|---|---|---|---|---|
| 1,959,516 | A | 8/1930 | Baker | |
| 1,901,981 | A * | 3/1933 | Ousback | 173/115 |
| 1,978,058 | A * | 10/1934 | Peterson | 123/78 E |
| 2,873,611 | A * | 2/1959 | Biermann | 74/40 |
| 2,909,164 | A * | 10/1959 | Biermann | 123/48 B |
| 3,507,337 | A * | 4/1970 | Chromy | 173/14 |
| 4,436,163 | A * | 3/1984 | Simpson | 173/117 |
| 4,991,664 | A * | 2/1991 | Kolgan et al. | 173/201 |
| 6,520,266 | B2 * | 2/2003 | Bongers-Ambrosius et al. | 173/2 |
| 7,533,736 | B2 | 5/2009 | Stirm et al. | |
| 7,562,721 | B2 * | 7/2009 | Stirm et al. | 173/201 |
| 7,658,012 | B2 * | 2/2010 | James et al. | 30/392 |
| 2005/0247462 | A1 * | 11/2005 | Meixner et al. | 173/48 |
| 2008/0149359 | A1 * | 6/2008 | Meixner | 173/128 |
| 2008/0236855 | A1 * | 10/2008 | Meixner et al. | 173/201 |
| 2008/0314610 | A1 * | 12/2008 | Meixner | 173/216 |
| 2009/0266572 | A1 * | 10/2009 | Meixner et al. | 173/205 |

FOREIGN PATENT DOCUMENTS

| | | |
|---|---|---|
| EP | 1584422 | 10/2005 |
| GB | 0670643 | 4/1952 |
| GB | 2403181 | 12/2004 |
| WO | WO 2006120051 A1 * | 11/2006 |
| WO | WO 2007073956 A1 * | 7/2007 |

* cited by examiner

*Primary Examiner* — Brian D Nash
*Assistant Examiner* — Michelle Lopez
(74) *Attorney, Agent, or Firm* — Abelman, Frayne & Schwab

(57) ABSTRACT

A hand-held power tool includes a motor-driven percussion mechanism. The percussion mechanism includes a guide tube (21) and a reciprocating driving member (22) displaceable in the guide tube (21) for driving, via a gas spring, an impact member (23) likewise displaceable in the guide tube (21). The percussion mechanism further includes a motor-driven eccentric wheel (17) rotatable about an axis (D) which is spaced from the percussion mechanism axis (S) in a direction perpendicular to the percussion mechanism axis (S) by a distance (X). A connection rod (29) is eccentrically supported on the eccentric wheel (17) and connected to the driving member (22) for converting a rotational movement of the eccentric wheel (17) into a reciprocating movement of the driving member (22).

4 Claims, 2 Drawing Sheets

HAND-HELD POWER TOOL WITH A PNEUMATIC PERCUSSION MECHANISM

BACKGROUND OF THE INVENTION

1. Field of the Invention

The present invention relates to a hand-held power tool such as, e.g., a chisel or combination hammer and including a motor-driven pneumatic percussion mechanism that includes a guide tube, an impact member displaceable in the guide tube, a reciprocating driving member for driving the impact member, a gas spring located between the driving member and the impact member for transmitting a driving motion of the driving member to the impact member, a motor-driven eccentric wheel rotatable about a stationary, with respect to the power tool, axis and a connection rod eccentrically supported on the eccentric wheel and connected to the driving member for converting a rotational movement of the eccentric wheel into a reciprocating movement of the driving member 2. Description of the Prior Art European Publication EP 1 584 422 A1 discloses an electrically driven drilling and/or chisel hammer having a percussion mechanism located in the tool housing and driven by a motor. The percussion mechanism includes a driving member such as a driving piston displaceable in a guide tube and movable to and from by a motor-driven connection rod. The connection rod is eccentrically supported with its end remote from the driving piston on an eccentric wheel rotatable about a stationary axis. The driving member drives, via an air cushion or an air spring, a percussion piston likewise displaceable in the guide tube. The percussion piston imparts blow via an anvil to a working tool receivable in the chuck of the power tool. In order to reduce peak pressures in the percussion mechanism, there is provided, between the driving piston and the percussion piston, in addition to the air or gas spring, an elastic mechanical compression spring. Such a percussion mechanism is very robust and powerful.

An object of the present invention is to optimize the pressure surge in the percussion mechanism in a constructively simple manner.

SUMMARY OF THE INVENTION

This and other objects of the present invention, which will become apparent hereinafter, are achieved by arranging in the percussion mechanism discussed above, the rotational axis of the eccentric wheel at a distance from the percussion mechanism axis in a direction perpendicular to the percussion mechanism axis.

The spacing of the rotational axis of the eccentric wheel from the percussion mechanism axis in the direction perpendicular to the percussion mechanism axis insures that the pressure surge in the percussion mechanism is reduced during an operational stroke but, despite that, the same single stroke energy is achieved or, at the same maximal pressure, a higher single stroke energy is achieved.

It is advantageous when the distance between the rotational axis of the eccentric wheel and the percussion mechanism axis lies in a range from 10% to 80% of a radius of the eccentric wheel. This permits to achieve a pressure reduction in the percussion mechanism in a range from 2% (when this distance amounts to 10% of the eccentric wheel radius) to 10% (when this distance amounts to 80% of the eccentric wheel radius).

Advantageously, the connection rod is formed as a crank. This permits to prevent a collision with the guide tube in constructively simple manner. The crank angle amounts advantageously to from 5° to 45° in accordance the above-mentioned constructive ratios.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
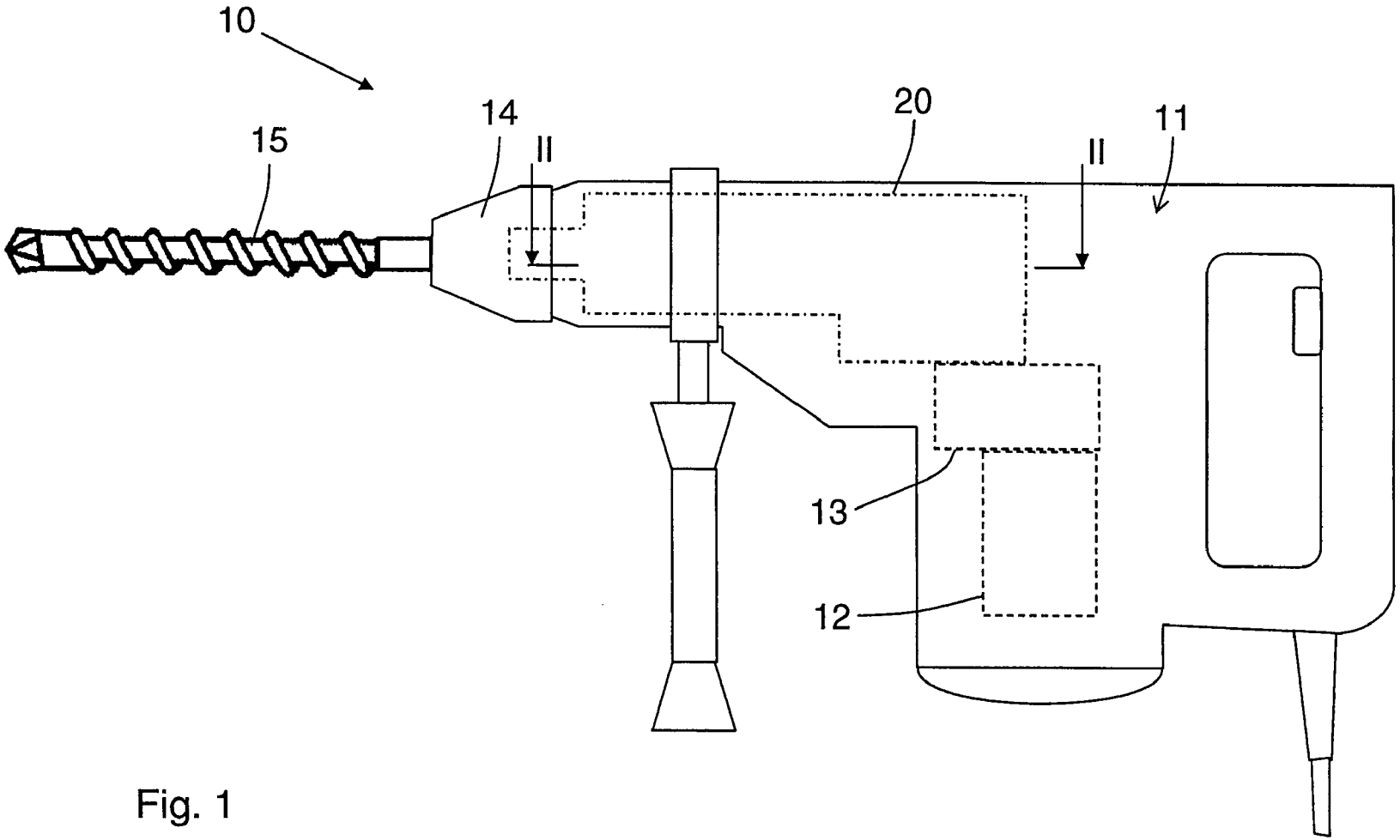
FIG. 1 a side view of a hand-held power tool with a pneumatic percussion mechanism according to the present invention.

A hand-held power tool 10 according to the present invention, which is formed as a rotary-percussion combination hammer and which is shown in FIG. 1, includes a housing 11, a percussion mechanism 20 located in the housing 11 for applying blows to a working tool 15 receivable in a chuck 14, and a gear unit 13 and a motor 12 likewise located in the housing 11. A driven shaft (not shown in the drawings) connects the percussion mechanism 20 with a gear unit 13 that transmits a rotational movement of the motor 12 via the driven shaft to an eccentric wheel 17, shown in FIG. 2, that is rotatable in a rotational direction 16.

Figure 2:
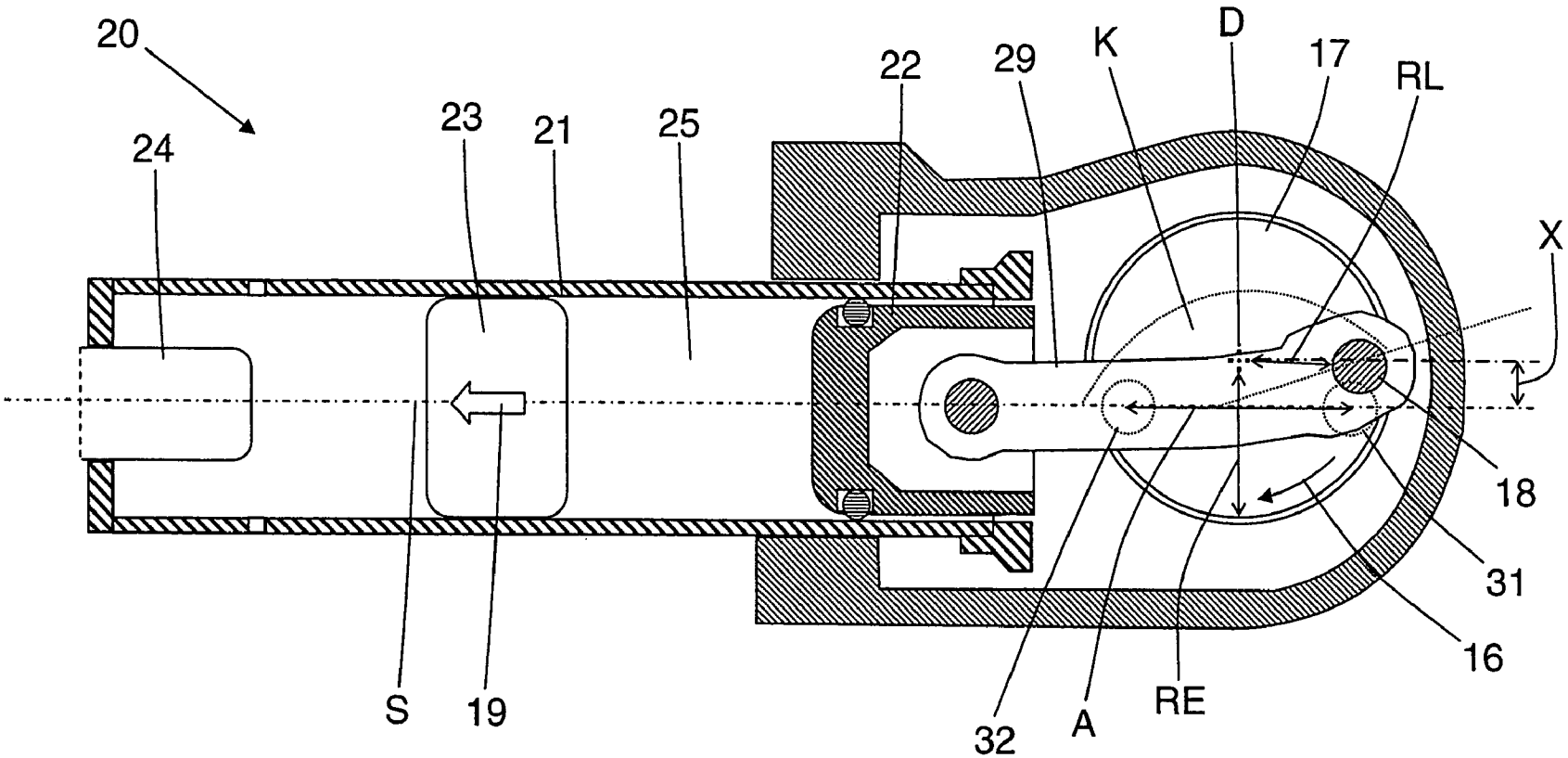
FIG. 2 a cross-sectional view along line II-II in FIG. 1.

The percussion mechanism 20 is shown in detail in FIG. 2. The percussion mechanism 20 has a guide tube 21 in which a driving member 22, which is formed as a driving piston, reciprocates. In order to facilitate assembly of the percussion mechanism, the guide tube 21 can be formed of two or more parts. For generating a reciprocating movement during operation of the hand-held power tool 10, the driving member 22 is connected with the eccentric wheel 17 by a connection rod 29 that is pivotally secured to the eccentric wheel 17. The connection rod 29 is connected with the eccentric wheel 17 by being pivotally mounted on a support journal 18 which is provided on the eccentric wheel 17, whereby the rotational movement of the eccentric wheel 17 in the rotational direction 16 is transformed in an oscillating reciprocating movement of the driving member 22. The eccentric wheel 17 rotates about a rotational axis D. Further, an impact member 23, which is formed as a percussion piston, and an anvil 24 are axially displaceable in the guide tube 21. The driving piston, the driving member 22, and an air spring 25, which is located between the driving member 22 and the impact member 23, impart a reciprocating movement to the impact member 23. The impact member 23 applies, during an operation of the power tool 10 in a percussion mode, blows to the anvil 24 that itself applies blows to the working tool 15 (see FIG. 1). Alternatively, the impact member 23 can apply blows directly to an end of a working tool. The air spring 25 or a gas spring (according to a used gas or gas mixture), which is located between the driving member 22 and the impact member 23, can be turned on and off by appropriate switching means (not shown in the drawings).

The percussion mechanism 20 defines a central axis S of the percussion mechanism that extends centrally through the guide tube 21 and the elements movable therein (driving member 22, etc.). The rotational axis D of the eccentric wheel 17 is offset with respect to the percussion mechanism axis S by a distance X in a direction perpendicular to the axis S, whereby the pressure surge in the percussion mechanism 20 is reduced during an operational stroke. However, despite that, the same single stroke energy is achieved or, at the same maximal pressure, a higher single stroke energy is achieved. The rotational axis D is rotatable clockwise and, with respect to the impact direction 19 of the percussion mechanism 20, moving rightwardly relative to the percussion mechanism axis S. With the percussion mechanism rotatable counter-clockwise, the rotational axis D of the eccentric wheel 17 would move relative to the percussion mechanism axis S in opposite direction. The distance X corresponds to 0.1 to 0.8 times of the radius RE of the eccentric wheel 17.

Taken with respect to the percussion mechanism axis S, an axial distance A between two possible passing points (shown with dotted circles 31, 32) of the support journal 18 through the percussion mechanism axis S during the rotation of the eccentric wheel 17 is smaller then the double radial distance RL of the support journal 18 relative to the rotational axis D of the eccentric wheel 17. Preferably, the connection rod is formed as a crank, with a crank angle lying preferably in a range between 5° and 45°.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hand-held power tool, comprising:

a pneumatic percussion mechanism (20) defining a central pneumatic mechanism axis (S); and a motor (12) for driving the percussion mechanism (20);

wherein the percussion mechanism (20) includes:

a guide tube (21), an impact member (23) displaceable in the guide tube (21), a reciprocating driving member (22) for driving the impact member (23), a gas spring (25) located between the driving member (22) and the impact member (23) for transmitting a driving motion of the driving member (22) to the impact member (23), a motor-driven eccentric wheel (17) rotatable about a stationary, with respect to the power tool, axis (D), the axis (D) being spaced from the percussion mechanism axis (S) in a direction perpendicular to the percussion mechanism axis (S) by a distance (X) wherein the distance (X) between the rotational axis (D) of the eccentric wheel (17) and the percussion mechanism axis (S) lies in a range from 10% to 80% of a radius (RE) of the eccentric wheel (17), and a connection rod (29) eccentrically supported on the eccentric wheel (17) and connected to the driving member (22) for converting a rotational movement of the eccentric wheel (17) into a reciprocating movement of the driving member (22).

2. A hand-held power tool according to claim 1, wherein the connection rod (29) is formed as a crank.

3. A hand-held power tool, comprising:

a pneumatic percussion mechanism (20) defining a central pneumatic mechanism axis (S); and a motor (12) for driving the percussion mechanism (20);

wherein the percussion mechanism (20) includes:

a guide tube (21), an impact member (23) displaceable in the guide tube (21), a reciprocating driving member (22) for driving the impact member (23), a gas spring (25) located between the driving member (22) and the impact member (23) for transmitting a driving motion of the driving member (22) to the impact member (23), a motor-driven eccentric wheel (17) rotatable about a stationary, with respect to the power tool, axis (D), the axis (D) being spaced from the percussion mechanism axis (S) in a direction perpendicular to the percussion mechanism axis (S) by a distance (X), and a connection rod (29) eccentrically supported on the eccentric wheel (17) and directly connected with one end to the motor-driven eccentric wheel (17) and directly connected with another end to the driving member (22) for converting a rotational movement of the eccentric wheel (17) into a reciprocating movement of the driving member (22), wherein the distance (X) between the rotational axis (D) of the eccentric wheel (17) and the percussion mechanism axis (S) lies in a range from 10% to 80% of a radius (RE) of the eccentric wheel (17).

4. A hand-held power tool according to claim 3, wherein the connection rod (29) is formed as a crank.

* * * * *